US008143541B2

(12) United States Patent
Tanabe et al.

(10) Patent No.: US 8,143,541 B2
(45) Date of Patent: Mar. 27, 2012

(54) MOVABLE CONTACT ASSEMBLY INCLUDING LIGHT INLET HAVING PLURAL GROOVES, AND SWITCH USING THE SAME

(75) Inventors: Koji Tanabe, Osaka (JP); Yousuke Chikahisa, Hyogo (JP); Tsutomu Aisaka, Osaka (JP)

(73) Assignee: Panasonic Corporation, Osaka (JP)

( * ) Notice: Subject to any disclaimer, the term of this patent is extended or adjusted under 35 U.S.C. 154(b) by 423 days.

(21) Appl. No.: 12/246,417

(22) Filed: Oct. 6, 2008

(65) Prior Publication Data

US 2009/0095612 A1 Apr. 16, 2009

(30) Foreign Application Priority Data

Oct. 12, 2007 (JP) ..... 2007-266345

(51) Int. Cl.
*H01H 9/00* (2006.01)

(52) U.S. Cl. ..... 200/310

(58) Field of Classification Search ..... 200/310, 200/311, 314; 362/602, 221; 361/679.08
See application file for complete search history.

(56) References Cited

U.S. PATENT DOCUMENTS

| | | | | |
|---|---|---|---|---|
| 2003/0123247 | A1* | 7/2003 | Parker et al. | 362/31 |
| 2003/0137824 | A1* | 7/2003 | Shinohara et al. | 362/31 |
| 2005/0013127 | A1 | 1/2005 | Tsai | |
| 2007/0012553 | A1* | 1/2007 | Lee et al. | 200/310 |
| 2007/0039809 | A1 | 2/2007 | Aihara et al. | |
| 2007/0195523 | A1* | 8/2007 | Chang | 362/224 |

FOREIGN PATENT DOCUMENTS

| | | |
|---|---|---|
| JP | 2007-087749 | 4/2007 |
| JP | 2007-87749 A | 4/2007 |

OTHER PUBLICATIONS

Chinese Office action dated Jul. 14, 2010.

* cited by examiner

*Primary Examiner* — Vanessa Girardi
(74) *Attorney, Agent, or Firm* — Pearne & Gordon LLP

(57) ABSTRACT

A movable contact assembly includes a light guiding sheet which is light transmittable, and a movable contact provided on the light guiding sheet. The light guiding sheet has a portion having the movable contact provided thereon and a portion having plural grooves provided therein. The grooves constitute a light inlet for introducing light into the light guiding sheet. This movable contact assembly can illuminate a switch preferably with a simple structure, providing the switch with an easily operation.

22 Claims, 5 Drawing Sheets

MOVABLE CONTACT ASSEMBLY INCLUDING LIGHT INLET HAVING PLURAL GROOVES, AND SWITCH USING THE SAME

FIELD OF THE INVENTION

The present invention relates to a movable contact assembly and a switch using the assembly.

BACKGROUND OF THE INVENTION

Recently, various electronic devices, especially mobile terminals, such as potable phones, have included light emitting diodes or electroluminescence elements for illuminating operating sections so that push buttons or display sheets can be easily operated and identified even when it is dark around the devices. Movable contact assemblies and switches used in these devices are required to be inexpensive and allow various illuminations.

FIG. 7 is a sectional view of conventional movable contact assembly 4. Light guiding sheet 1 having a film shape is light-transmittable and has flexibility. Diffusing portions 1A are formed on an upper surface of light guiding sheet 1. Light guiding sheet 1 has a predetermined portion of a periphery attached with adhesive onto cover sheet 2 having a film shape.

Movable contact 3 is made of thin plate of conductive metal having a substantially dome shape. Plural Movable contacts 3 are attached onto a lower surface of cover sheet 2 under diffusion portions 1A with an adhesive, thus providing movable contact assembly 4.

FIG. 8 is a sectional view of conventional switch 501. Wiring board 5 has wiring patterns on upper and lower surfaces thereof. Fixed contacts 6 including center fixed contacts 6A and outer fixed contacts 6B are provide on an upper surface of wiring board 5. Each center fixed contact 6A has a substantially circular shape. Each outer fixed contact 6B has a substantially horseshoe shape or a substantially ring shape that surrounds center fixed contact 6A.

Movable contact assembly 4 is attached onto the upper surface of wiring board 5. An outer periphery of movable contact 3 is mounted onto outer fixed contact 6B. The center of a lower surface of movable contact 3 faces center fixed contact 6A with a predetermined gap.

Light emitting element 7, such a light emitting diode, is mounted onto the upper surface of wiring board 5 and at the right side of light guiding sheet 1. Light emitting element 7 has a light emitting surface facing right edge surface 1C of light guiding sheet 1.

Actuator 8 made of insulating resin includes is formed of light-transmittable portion 8A and light-blocking portion 8B covering an upper surface of actuator 8. Display portion 8C including exposing light-transmittable portion 8A exposed in a shape of characters or symbols is provided on the upper surface of actuator 8. Pressing portion 8D projecting downward from actuator 8 contacts the upper surface of light guiding sheet 1 above the center of movable contact 3.

Movable contact assembly 4 and wiring board 5 are accommodated in case 9 made of insulating resin having a substantially box shape. Actuator 8 is vertically movably mounted in an opening provided in an upper surface of case 9, thus providing switch 501.

Switch 501 is mounted to an operation panel of an electronic device. Center fixed contacts 6A, outer fixed contacts 6B, and light emitting element 7 are connected to an electronic circuit of the electronic device via the wiring patterns.

When actuator 8 is pressed down, pressing portion 8D on the lower surface of actuator 9 presses light guiding sheet 1, and light guiding sheet 1 and cover sheet 2 bend accordingly, thereby applying a pressing force to the center of the substantially dome shape of movable contact 3. When the pressing force exceeds a predetermined value, movable contact 3 has its shape elastically reversed downward with a click feeling, and the center of the lower surface of movable contact 3 contacts center fixed contact 6A. Thereby, center fixed contact 6A is electrically connected to outer fixed contact 6B via movable contact 3.

When the pressing force to actuator 8 is released, movable contact 3 has its shape elastically reversed upward by an elastic restoring force, the center of the lower surface of movable contact 3 is removed from center fixed contact 6A, thereby disconnecting center fixed contact 6A electrically from outer fixed contact 6B.

According to the electrical connection and disconnection between fixed contacts 6A and 6B, the electronic circuit switches functions of the electronic device.

The electronic circuit applies a voltage is applied to light emitting element 7 to generate light LL. Light LL is introduced from right edge surface 1C into light guiding sheet 1, and travels left in light guiding sheet 1 while being reflected on surfaces of the light guiding sheet. This light is diffused by diffusing portions 1A on the upper surface of light guiding sheet 1, and illuminates display portion 8C of actuator 8 from beneath. Even in dark environment, a user can identify the characters or symbols of display portion 8C, and easily operate the electronic device.

In switch 501 including movable contact assembly 4, the light from light emitting element 7 is guided into light guiding sheet 1 from the edge surface perpendicular to the light. When light guiding sheet 1 is thin, a sufficient amount of light cannot be guided into light guiding sheet 1, light from diffusing portions 1A becomes weak, accordingly preventing display portion 8C from being illuminated brightly.

SUMMARY OF THE INVENTION

A movable contact assembly includes a light guiding sheet which is light transmittable, and a movable contact provided on the light guiding sheet. The light guiding sheet has a portion having the movable contact provided thereon and a portion having plural grooves provided therein. The grooves constitute a light inlet for introducing light into the light guiding sheet.

This movable contact assembly can illuminate a switch preferably with a simple structure, providing the switch with an easily operation.

DETAILED DESCRIPTION OF THE INVENTION

Figure 1A:
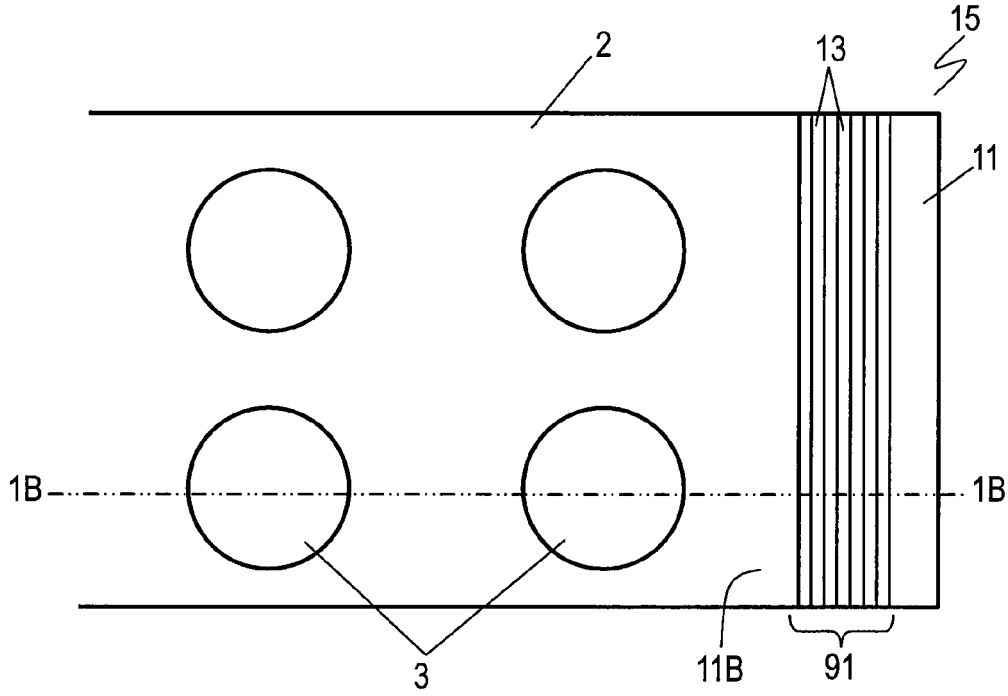
FIG. 1A is a bottom view of a movable contact assembly in accordance with an exemplary embodiment of the present invention.
Figure 1B:
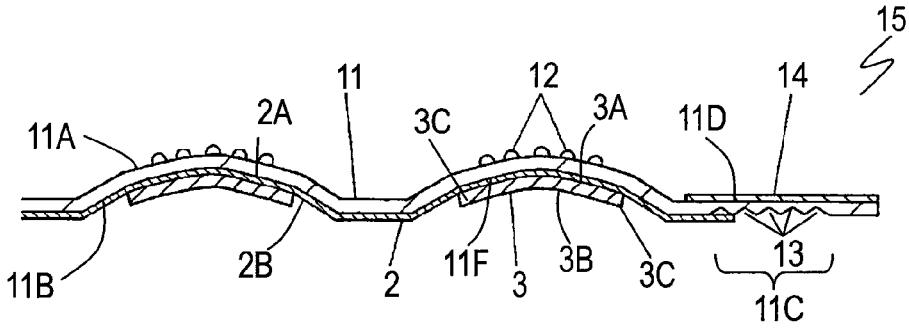
FIG. 1B is a sectional view of the movable contact assembly at line 1B-1B shown in FIG. 1A.

FIG. 1A is a bottom view of movable contact assembly 15 in accordance with an exemplary embodiment of the present invention. FIG. 1B is a sectional view of movable contact assembly 15 at line 1B-1B shown in FIG. 1A. Light guiding sheet 11 is made of light-transmittable material, such as polyethylene terephthalate, polycarbonate, polyurethane, or silicone, having flexibility. Light guiding sheet 11 has upper surface 11A and lower surface 11B opposite to upper surface 11B. Light guiding sheet 11 has diffusing portions 12 having dot shapes provided on upper surface 11A. Diffusing portions 12 are made of transparent resin, such as acrylic resin, including white pigment, such as titanium oxide, dispersed in the transparent resin. A predetermined portion of an outer periphery of upper surface 2A of cover sheet 2 having a film shape is attached onto lower surface 11B of light guiding sheet 11 with an adhesive.

Movable contact 3 is made of thin plate of conductive metal, such as copper alloy or steel, and has a substantially dome shape having convex surface 3A and concave surface 3B opposite to convex surface 3A. Convex surfaces 3A of movable contacts 3 are attached onto portions 11F of lower surface 2B of cover sheet 2, thus providing movable contact assembly 15. Movable contacts 3 face diffusing portions 12 across a component, such as cover sheet 2.

Grooves 13 extending in parallel with each other are formed in portion 11C of lower surface 11B of light guiding sheet 11 onto which movable contacts 3 are not attached. Grooves 13 constitute light inlet 91 for introducing light into light guiding sheet 11. Reflector 14 for reflecting light is provided on portion 11D of upper surface 11A opposite to portion 11C of lower surface 11B. Reflector 14 is made of light-reflecting material, such as aluminum foil or film having aluminum deposited thereon, attached onto portion 11D of upper surface 11A. Reflector 14 may be made of transparent resin, such as polyester or epoxy, and light-reflecting particles, such as aluminum or silver, having scale shapes dispersed in the transparent resin.

Figure 2:
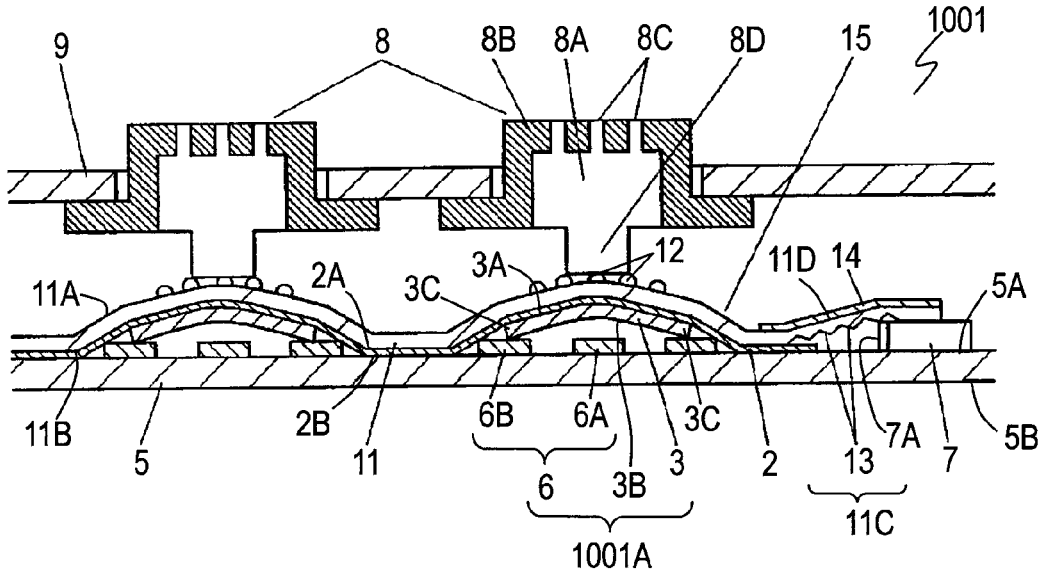
FIG. 2 is a sectional view of a switch in accordance with the embodiment.

FIG. 2 is a sectional view of switch 1001 including movable contact assembly 15. Wiring board 5 is made of an insulating film, such as a polyethylene terephthalate film or a polycarbonate film, or an insulating plate, such as a paper reinforced phenolic plate or a fibreglass reinforced epoxy laminate plate. Wiring patterns made of conductive material, such as copper, are formed on upper surface 5A and lower surface 5B of wiring board 5. Center fixed contacts 6A and outer fixed contacts 6B made of conductive material, such as copper or carbon, are provided on upper surface 5A. Each center fixed contact 6A has a substantially circular shape. Each outer fixed contact 6B has a substantially horseshoe shape or substantially ring shape surrounding center fixed contact 6A. Center fixed contacts 6A and outer fixed contacts 6B constitute fixed contacts 6. Movable contacts 3 and fixed contacts 6 constitute switch unit 1001A which is turned on and off.

Movable contact assembly 15 is attached onto upper surface 5A of wiring board 5 so that lower surface 2B of cover sheet 2 is situated on upper surface 5A of wiring board 5. At this moment, outer edge 3C of movable contact 3 is mounted on outer fixed contact 6B. Concave surfaces 3B of movable contacts 3 face center fixed contacts 6A at a predetermined gap.

Light emitting element 7, such as a light emitting diode, has light emitting surface 7A for emitting light, and is mounted between lower surface 11B of light guiding sheet 11 and upper surface 5A of wiring board 5. Portion 11C of lower surface 11B of light guiding sheet 11 is folded slightly upward, and is mounted on light emitting element 7. Light emitting surface 7A of light emitting element 7 faces grooves 13, and introduces light into light guiding sheet 11 through grooves 13, i.e., light inlet 91.

Actuator 8 made of insulating resin, such as polystyrene or acrylonitrile butadiene styrene (ABS), includes light-transmittable portion 8A for transmitting light and light-blocking portion 8B covering an upper surface of light-transmittable portion 8A. Display portion 8C including light-transmittable portion 8A exposed in a shape of characters or symbols is provided on the upper surface of actuator 8. Actuator 8 has pressing portion 8D projecting downward. Pressing portion 8D contacts upper surface 11A of light guiding sheet 11, particularly contacts diffusing portions 12. Pressing portion 8D faces convex surface 3A of movable contact 3 across light guiding sheet 11 and cover sheet 2.

Movable contact assembly 15 and wiring board 5 are accommodated in case 9 that is made of insulating resin and has a substantially box shape. Actuators 8 are mounted in case 9 as well as movable contact assembly 15 and wiring board 5, so that actuators 8 are vertically movable in openings provided in an upper surface of case 9, thus providing switch 1001. Switch 1001 is mounted to an operation panel of an electronic device. Center fixed contacts 6A, outer fixed contacts 6B, and light emitting element 7 are connected to an electronic circuit of the electronic device via the wiring patterns.

An operation of switch 1001 will be described below. When actuator 8 is pressed down, pressing portion 8D presses upper surface 11A of light guiding sheet 11. Light guiding sheet 11 and cover sheet 2 is accordingly bent to apply a pressing force to convex surface 3A of movable contact 3. When the pressing force exceeds a predetermined value, the dome shape of movable contact 3 is reversed with a click feeling. Then, convex surface 3A and concave surface 3B deform to be a concave surface and a convex surface, respectively, and concave surface 3B contacts center fixed contact 6A. Thus, center fixed contact 6A is electrically connected to outer fixed contact 6B via movable contact 3, thus turning on switch unit 1001A.

When the pressing to actuator 8 is released, movable contact 3 is returned to the dome shape by an elastic restoring force. Thus, concave surface 3B of movable contact 3 is removed from center fixed contact 6A, and center fixed contact 6A is electrically disconnected from outer fixed contact 6B, thereby turning off switch unit 1001A.

The electronic circuit switches functions of the electronic device in response to the electrical connection and disconnection between fixed contacts 6 (6A, 6B).

The electronic circuit applies a voltage to light emitting element 7. When the voltage is applied to light emitting element 7, light emitting element 7 emits light from light emitting surface 7A. This light enters into light guiding sheet 11 from grooves 13 in portion 11C of lower surface 11B of light guiding sheet 11. The electronic circuit may apply the voltage according to the electrical connection and disconnection between fixed contacts 6 (6A, 6B)

Figure 3:
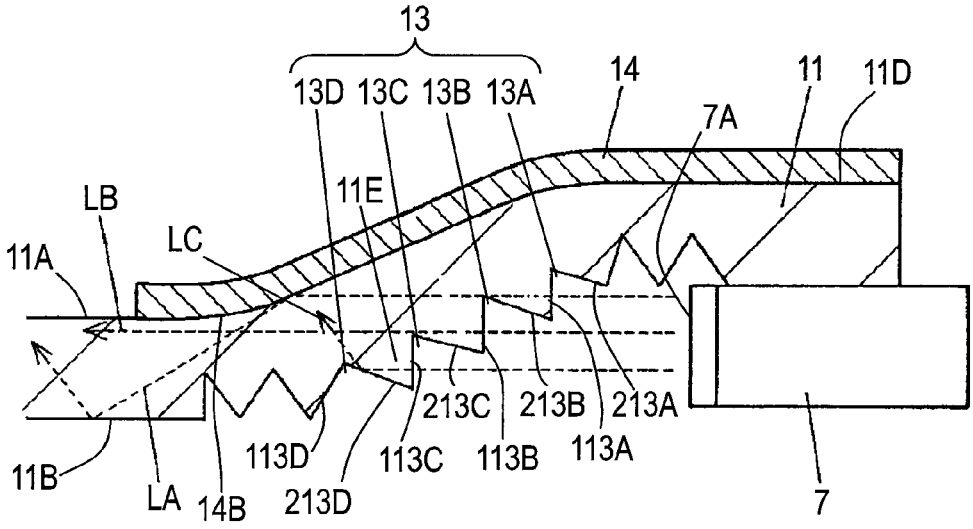
FIG. 3 is an enlarged sectional view of the switch in accordance with the embodiment.

FIG. 3 is an enlarged sectional view of switch 1001. The light from light emitting surface 7A of light emitting element 7 passes through grooves 13 having stripe shapes including grooves 13A, 13B, 13C, and 13D, and enters into light guiding sheet 11. Grooves 13A, 13B, and 13C have side surfaces 113A, 113B, and 113C substantially perpendicular to lights LA, LB, and LC emitted from light emitting surface 7A, respectively, and have side surfaces 213A, 213B, and 213C facing side surfaces 113A, 113B, and 113C, respectively. Groove 13D has side surface 113D facing towards substantially the same direction as side surface 113C of groove 13C, and has side surface 213D facing side surface 113D. Side surface 213D is located opposite to side surface 113C of groove 13C beyond portion 11E of lower surface 11B of light guiding sheet 11.

Light LA passed through side surface 113A of groove 13A is reflected on lower surface 14B of reflector 14, is then reflected on lower surface 11B of light guiding sheet 11, and passes in light guiding sheet 11. Light LB passing through side surface 113B of groove 13B passes in light guiding sheet 11. Light LC passing through side surface 113C of groove 13C is reflected on side surface 213D of groove 13D. Then, light LC passes in light guiding sheet 11 while being repeatedly reflected on lower surface 14B of reflector 14 and lower surface 11B and upper surface 11A of light guiding sheet 11. Thus, a large amount of light passes through grooves 13A to 13C having side surfaces 113A to 113C passes in light guiding sheet 11.

The large amount of light having passes in light guiding sheet 11 is diffused and reflected on diffusing portions 12 provided on upper surface 11A of light guiding sheet 11 to cause diffusing portions 12 to shine, and illuminates light-transmittable portion 8A of actuator 8 from beneath. This light illuminates display portion 8C, and allows a user to identify display portion 8C so as to easily operate switch 1001 even in dark environment.

The light from light emitting surface 7A of light emitting element 7 enters into grooves 13 having the stripe shapes provided not in an edge surface but in lower surface 11B of light guiding sheet 11, and passes in light guiding sheet 11, allowing a large amount of light to illuminate light-transmittable portion 8A. Therefore, in movable contact body 4, even if light guiding sheet 11 is thin and has a small edge surface, a large amount of light can enter into light guiding sheet 11 to illuminate light-transmittable portion 8A brightly.

Grooves 13 having the stripe shapes can be formed by heating and pressing portion 11C of lower surface 11B of light guiding sheet 11 with a die having a substantially prism shape having triangular columnar shape. Grooves 13 may be formed by screen-printing transparent insulating resin, such as acrylate, on lower surface 11B of light guiding sheet 11 or applying it to the lower surface with a dispenser having an injection needle shape. Alternatively, a transparent molded sheet having grooves 13 previously provided therein may be attached onto portion 11C of lower surface 11B of light guiding sheet 11 so as to form grooves 13 easily.

Figure 4A:
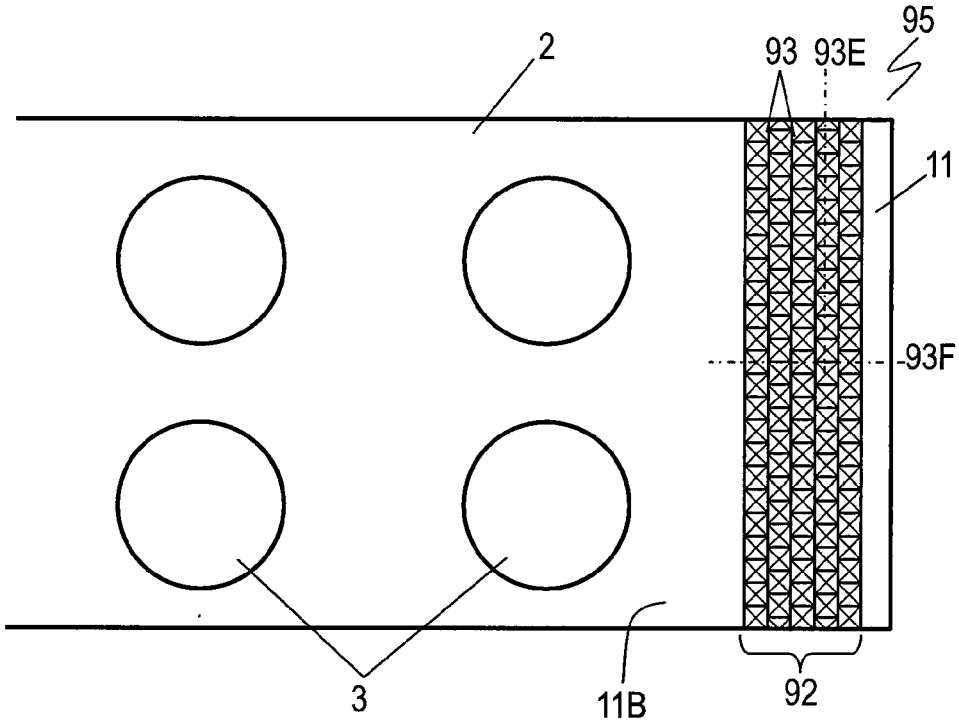
FIG. 4A is a bottom view of another movable contact assembly in accordance with the embodiment.
Figure 4B:
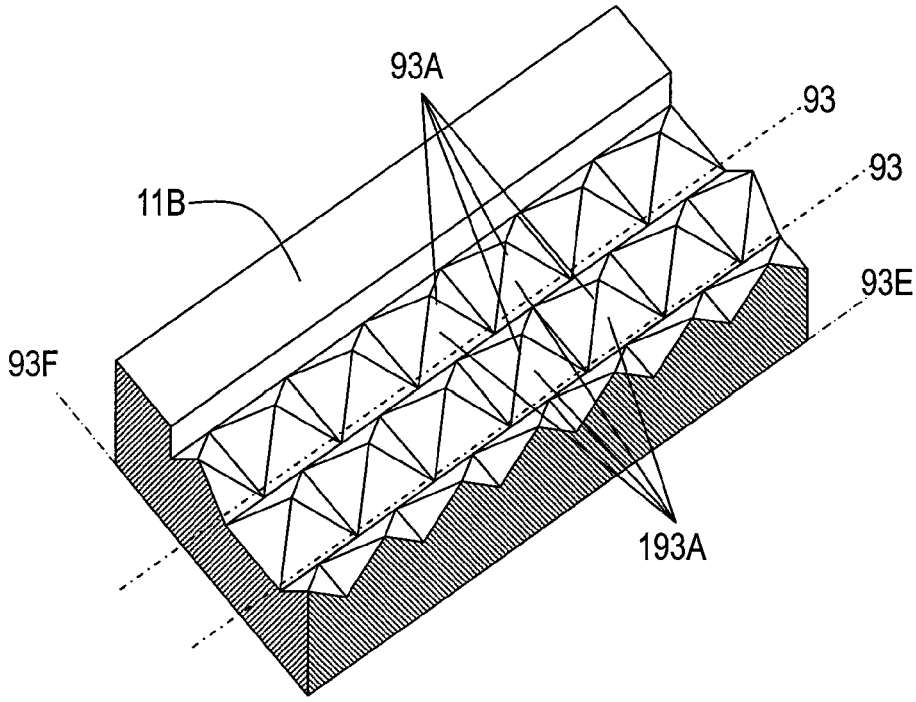
FIG. 4B is an enlarged view of the movable contact assembly shown in FIG. 4A.

FIG. 4A is a bottom view of another movable contact assembly 95 according to the embodiment. Movable contact assembly 95 includes light inlet 92 instead of light inlet 91 of movable contact assembly 15 shown in FIG. 1A. FIG. 4B is an enlarged view of movable contact assembly 95 shown in FIG. 4A. In FIGS. 4A and 4B, components identical to those of movable contact assembly 15 shown in FIG. 1A are denoted by the same reference numerals, and their description will be omitted. Light inlet 92 has ridges 93 extending in parallel with each other along direction 93E, as grooves 13 of light inlet 91. Each ridge 93 include protrusions 93A having polygonal pyramid shapes, such as quadrangular pyramid shapes. Each protrusion 93 has side surface 193A into which light enters. Side surfaces 193A of protrusions 93A of ridges 93 are deviated alternately in direction 93F perpendicular to direction 93E. As shown in FIG. 4B, ridges 93 provide plural grooves in lower surface 11B. Each of the grooves has a side surface into which light enters, and the grooves extend in parallel with each other in direction 93E.

The shapes of grooves 13 and ridges 93 may not be limited to those illustrated, but may have any shapes introducing light into light guiding sheet 11 efficiently.

Reflector 14 prevents light from leaking from upper surface 11A of light guiding sheet 11 and reflects the light, so that actuator 8 can be illuminated more brightly.

In movable contact assembly 15, cover sheet 2 having movable contacts 3 attached onto lower surface 2B is attached onto lower surface 11B of light guiding sheet 11. Another movable contact assembly according to the embodiment may not necessarily include cover sheet 2. In this case, movable contacts 3 are attached directly onto lower surface 11B of light guiding sheet 11 with an adhesive, thereby reducing the number of components, simplifying the structure of the movable contact assembly, and reducing the cost of the assembly.

In movable contact assembly 15, diffusing portions 12 having the dot shapes are provided on upper surface 11A of light guiding sheet 11. In still another movable contact assembly according to the embodiment, diffusing portions 12 having dot shapes may be provided on lower surface 11B of light guiding sheet 11.

Figure 5:
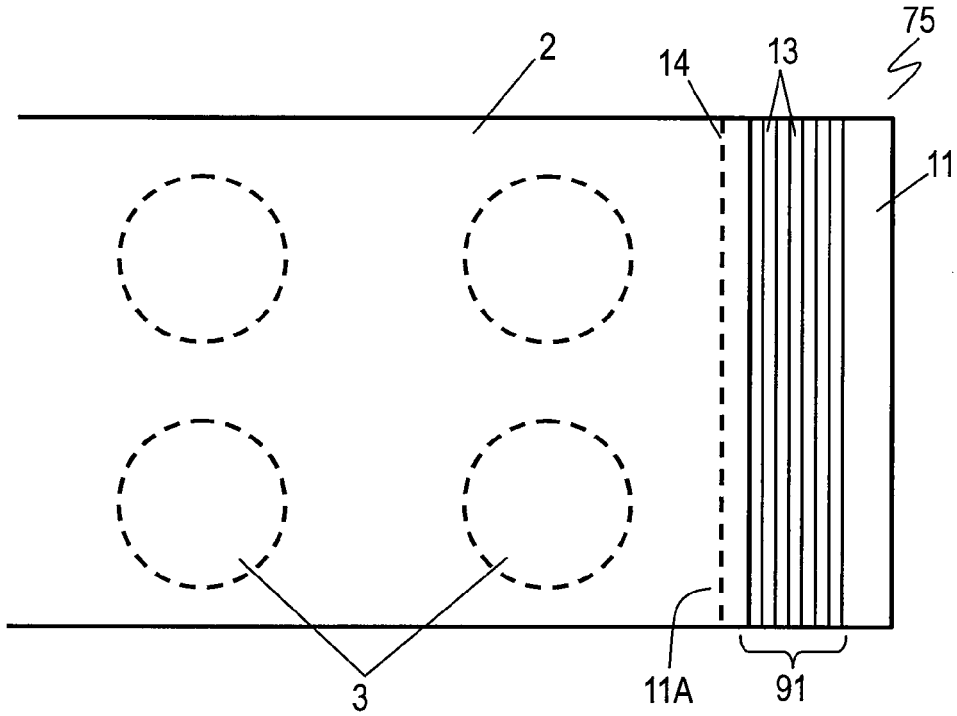
FIG. 5 is a top view of still another movable contact assembly in accordance with the embodiment.
Figure 6:
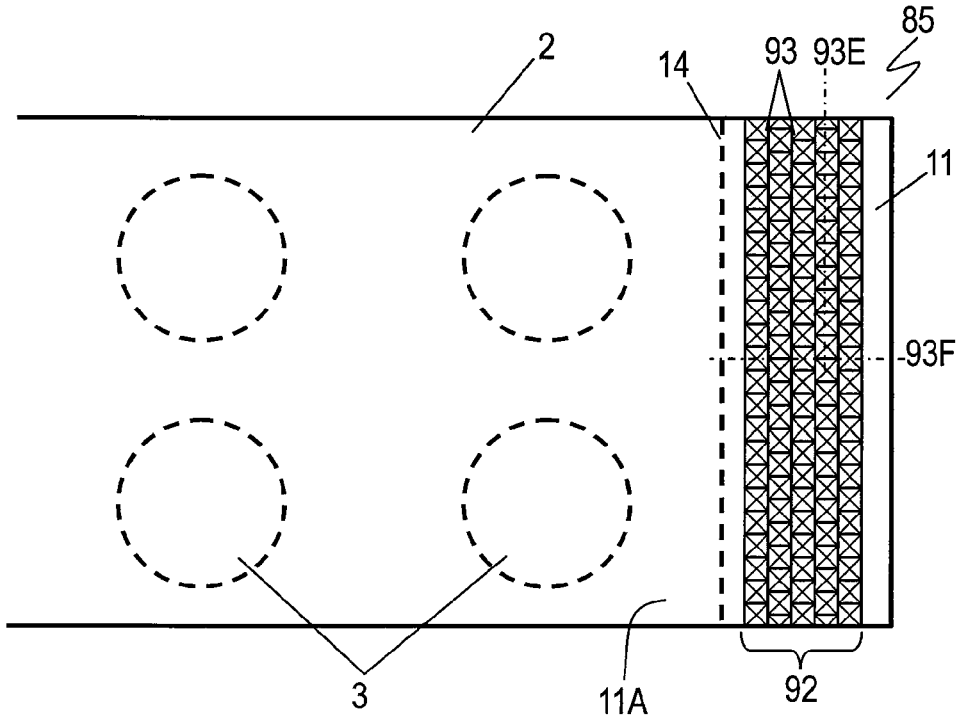
FIG. 6 is a top view of a further movable contact assembly in accordance with the embodiment.
Figure 7:
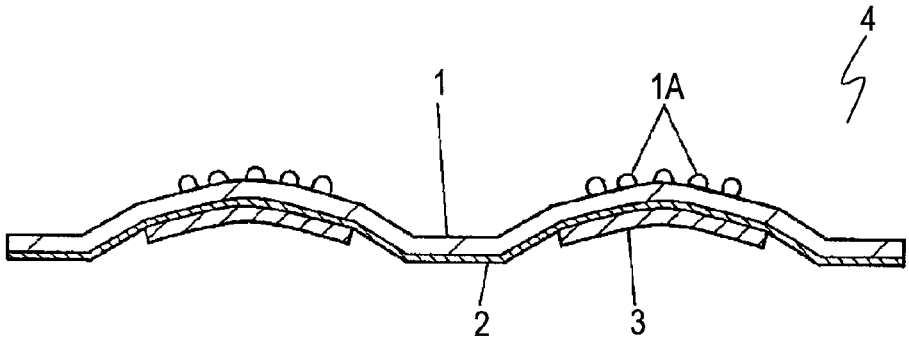
FIG. 7 is a sectional view of a conventional movable contact assembly.
Figure 8:
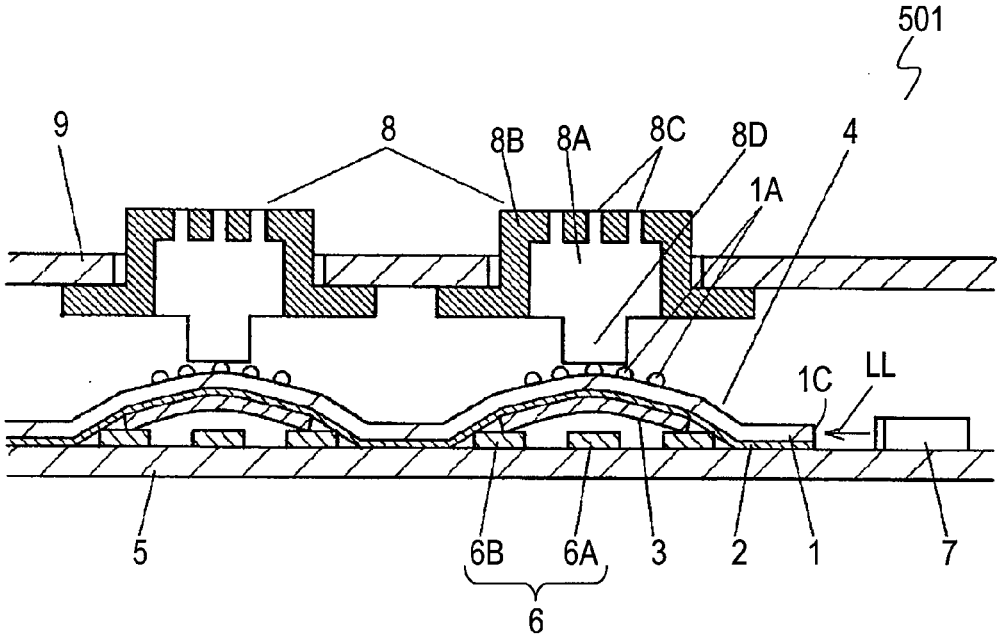
FIG. 8 is a sectional view of a conventional switch.

Light inlets 91 and 92 may be provided on upper surface 11A of light guiding sheet 11 to introduce light into light guiding sheet 11. In this case, reflector 14 is provided on lower surface 11B of light guiding sheet 11. FIG. 5 is a top view of still another movable contact assembly 75 according to the embodiment. In FIG. 5, components identical to those of movable assembly 15 shown in FIG. 1A are denoted by the same reference numerals, and their description will be omitted. In movable contact assembly 75, light inlet 91 having grooves 13 introducing light into light guiding sheet 11 is provided on upper surface 11A of light guiding sheet 11. Reflector 14 is provided on lower surface 11B of light guiding sheet 11. FIG. 6 is a top view of further movable contact assembly 85 according to the embodiment. In FIG. 6, components identical to those of movable assembly 95 shown in FIG. 4A are denoted by the same reference numerals, and their description will be omitted. In movable contact assembly 85, light inlet 92 having ridges 93 introducing light into light guiding sheet 11 is provided on upper surface 11A of light guiding sheet 11. Reflector 14 is provided on lower surface 11B of light guiding sheet 11.

Switch 1001 includes switch unit 1001A including of movable contacts 3 and fixed contacts 6. Another switch according to the embodiment may include a switch unit having another structure which is turned on and off instead of switch unit 1001A.

Terms, such as "upper surface" and "lower surface", indicating directions indicates relative directions depending on the arrangement of components, such as a light guiding sheet and movable contact 3, of movable contact assembly 15, and do not indicates absolute directions, such as a vertical direction.

What is claimed is:

1. A movable contact assembly comprising:

a light guiding sheet which is light transmittable, the light guiding sheet including a first portion and a second portion, the second portion of the light guiding sheet having a light inlet having a plurality of grooves provided therein, wherein the light inlet is arranged to introduce light into the light guiding sheet through surfaces of the plurality of grooves from an outside of the light guiding sheet; and a movable contact provided on the first portion of the light guiding sheet, wherein the light guiding sheet has two surfaces opposite to each other and a side edge surface which is connected to the two surfaces of the light guiding sheet, the side edge surface entirely surrounding an outer periphery of each of the two surfaces of the light guiding sheet, the movable contact is provided on one of the two surfaces of the light guiding sheet, and the light inlet is provided on one of the two surfaces of the light guiding sheet.

2. The movable contact assembly of claim 1, further comprising a reflector provided on the second portion of the light guiding sheet, the reflector facing the plurality of grooves across the light guiding sheet.

3. The movable contact assembly of claim 1, wherein said one of the two surfaces of the light guiding sheet on which the movable contact is provided is identical to said one of the two surfaces of the light guiding sheet on which the light inlet is provided.

4. The movable contact assembly of claim 1, wherein the movable contact is made of thin plate of conductive metal having a substantially dome shape having a convex surface and a concave surface opposite to the convex surface, the convex surface of the movable contact being provided on the first portion of the lower surface of the light guiding sheet.

5. The movable contact assembly of claim 1, wherein the plurality of grooves extend in parallel with each other.

6. The movable contact assembly of claim 1, wherein the light inlet includes a plurality of ridges, each of the ridges includes a plurality of protrusions having polygonal pyramid shapes.

7. The movable contact assembly of claim 1, wherein the light inlet is located proximate to an edge of the light guiding sheet.

8. The movable contact assembly of claim 1, wherein the plurality of grooves define the light inlet and are remotely located from the movable contact.

9. The movable contact assembly of claim 1, wherein the light guiding sheet has a lower surface, and the movable contact and the light inlet are provided on the lower surface of the light guiding sheet.

10. The movable contact assembly of claim 1, wherein the light inlet includes a plurality of ridges constituting the plurality of grooves, at least one of the plurality of ridges has a first surface and a second surface connected directly to the first surface, the second surface being opposite to the first surface with respect to the at least one of the plurality of ridges, the first surface being one of the plurality of the surface of the plurality of the grooves, the first surface being arranged to have light enter into the first surface, and the light entering into the first surface reflects at the second surface within the light guiding sheet.

11. The movable contact assembly of claim 1, wherein the light inlet is not provided on the side edge surface of the light guiding sheet.

12. A switch comprising:

a light guiding sheet which is light transmittable, the light guiding sheet including a first portion and a second portion, the second portion of the light guiding sheet having a light inlet having a plurality of grooves;

a switch unit provided on the first portion of the light guiding sheet; and a light emitting element for emitting light entering into the light guiding sheet through surfaces of the plurality of grooves of the light inlet from an outside of the light guiding sheet, wherein the light guiding sheet has two surfaces opposite to each other and a side edge surface which is connected to the two surfaces of the light guiding sheet, the side edge surface entirely surrounding an outer periphery of each of the two surfaces of the light guiding sheet, the switch unit is provided on one of the two surfaces of the light guiding sheet, and the light inlet is provided on one of the two surfaces of the light guiding sheet.

13. The switch of claim 12, wherein said one of the two surfaces of the light guiding sheet on which the movable contact is provided is identical to said one of the two surfaces of the light guiding sheet on which the light inlet is provided.

14. The switch of claim 12, wherein the switch unit includes a movable contact made of thin plate of conductive metal having a substantially dome shape having a convex surface and a concave surface opposite to the convex surface, the convex surface of the movable contact being provided on the first portion of the light guiding sheet; and a fixed contact facing the concave surface of the movable contact.

15. The switch of claim 12, further comprising a reflector provided on the second portion of the light guiding sheet, the reflector facing the plurality of grooves across the light guiding sheet.

16. The switch of claim 12, wherein the plurality of grooves extend in parallel with each other.

17. The switch of claim 12, wherein the light inlet includes a plurality of ridges, each of the ridges includes a plurality of protrusions having polygonal pyramid shapes.

18. The switch of claim 12, wherein the light inlet is located proximate to an edge of the light guiding sheet.

19. The switch of claim 12, wherein the plurality of grooves define the light inlet and are remotely located from the switch unit.

20. The switch of claim 12, wherein the light guiding sheet has a lower surface, and the switch unit and the light inlet are provided on the lower surface of the light guiding sheet.

21. The switch of claim 12, wherein the light inlet includes a plurality of ridges constituting the plurality of grooves, at least one of the plurality of ridges has a first surface and a second surface connected directly to the first surface, the second surface being opposite to the first surface with respect to the at least one of the plurality of ridges, the first surface being one of the plurality of the surface of the plurality of the grooves, the first surface being arranged to have light enter into the first surface, and the light entering into the first surface reflects at the second surface within the light guiding sheet.

22. The switch of claim 12, wherein the light inlet is not provided on the side edge surface of the light guiding sheet.

* * * * *